US007464845B2

(12) United States Patent
Chou

(10) Patent No.: US 7,464,845 B2
(45) Date of Patent: Dec. 16, 2008

(54) HAND-HELD STAPLE GUN HAVING A SAFETY DEVICE

(75) Inventor: Ammy Chou, Hsi Chih (TW)

(73) Assignee: Welcome Co., Ltd., Taipei (TW)

( * ) Notice: Subject to any disclaimer, the term of this patent is extended or adjusted under 35 U.S.C. 154(b) by 6 days.

(21) Appl. No.: 11/641,082

(22) Filed: Dec. 19, 2006

(65) Prior Publication Data

US 2007/0145094 A1 Jun. 28, 2007

(30) Foreign Application Priority Data

Dec. 22, 2005 (TW) ..... 94145788 A
Dec. 22, 2005 (TW) ..... 94145789 A
Oct. 11, 2006 (TW) ..... 95137326 A

(51) Int. Cl.
*B25C 5/11* (2006.01)

(52) U.S. Cl. ..... 227/132; 227/127; 227/134

(58) Field of Classification Search ..... 227/126, 227/127, 132
See application file for complete search history.

(56) References Cited

U.S. PATENT DOCUMENTS 2,285,512 A * 6/1942 Harley ..... 227/132
2,746,043 A * 5/1956 Zaller ..... 227/127
2,746,044 A * 5/1956 Cusumano et al. ..... 227/132
3,229,882 A * 1/1966 Abrams ..... 227/132
3,913,817 A * 10/1975 Barrett et al. ..... 227/126
3,948,426 A * 4/1976 La Pointe ..... 227/8
4,450,998 A * 5/1984 Ruskin ..... 227/8
6,082,604 A 7/2000 Dennis ..... 227/8
6,729,525 B2 5/2004 Chou ..... 227/140

* cited by examiner

*Primary Examiner*—Paul R. Durand
*Assistant Examiner*—Nathaniel Chukwurah
(74) *Attorney, Agent, or Firm*—Bacon & Thomas, PLLC

(57) ABSTRACT

A hand-held staple gun comprises a housing, a driver, a spring means, a handle, and a safe actuation mechanism. The safe actuation mechanism includes a swing means, a link, and an actuation control rod. The swing means is pivotally secured to the housing and the link is pivotally connected with the swing means. When the staple gun is not in use, the link cannot engage the driver even if the handle is pressed down, and when the staple gun is in use, the actuation control rod is pressed upward into the housing, so that the actuation control rod pushes the swing means, making the link engage the driver and therefore possible to drive staples out of the staple gun when pressing down of the handle.

18 Claims, 19 Drawing Sheets

HAND-HELD STAPLE GUN HAVING A SAFETY DEVICE

BACKGROUND OF THE INVENTION

1. Field of the Invention

The present invention relates to staple guns having a safety device and, more particularly, to a hand-held staple gun having a safe actuation mechanism.

2. Description of Related Art

Staple guns are powerful hand-held machine used to drive metal staples into, for instance, solid wood. Aside from the staple guns driven by electricity or compressed air, the staple guns of hand-powered (muscle power) models always have a spring means for storing mechanical energy and delivering it as a sharp powerful blow. As such, providing auxiliary devices attached to the staple guns for better accomplishing work, and particularly for safety, becomes important and necessary. Among others, examples may be given to U.S. Pat. No. 6,729,525, issued to Chou, for a staple gun having an improved structure for a two-dimensional positioning purpose; and U.S. Pat. No. 6,082,604, issued to Dennis, for a staple gun having an alignment device that prevents the staple gun from firing unless it is properly aligned with respect to an object to be fastened.

SUMMARY OF THE INVENTION

It is therefore an object of the present invention to provide a hand-held staple gun having a safety device, so that unintentional firing of the staple gun may be prevented and a safe use of the staple gun maintained.

It is a further object of the present invention to provide a hand-held staple gun having a safety device, wherein the safety device relates to a safe actuation mechanism including, among others, an actuation control rod which allows a driver of the staple gun to fire staples only when a user attempts to use the staple gun and thus presses on the actuation control rod intentionally.

According to the present invention, the hand-held staple gun comprises a housing, a driver, a spring means, a handle, and a safe actuation mechanism. The safe actuation mechanism includes a swing means, a link, and an actuation control rod. The swing means is pivotally secured to the housing and the link is pivotally connected with the swing means. When the staple gun is not in use, the link cannot engage the driver even if the handle is pressed downward, and when the staple gun is in use, the actuation control rod is pressed upward into the housing, so that the actuation control rod pushes the swing means, making the link engage the driver, where the driver, being biased by the spring means, is moved upward when the handle is pressed down, and when the handle is pressed down continuously, the link releases abruptly from the driver, making the driver rushes downward so as to drive the staples out of the staple gun, through the help of the elasticity force of the spring means.

Other objects, advantages, and novel features of the present invention will become more apparent from the following detailed descriptions when taken in conjunction with the accompanying drawings.

DETAILED DESCRIPTION OF THE PREFERRED EMBODIMENT

Figure 1:
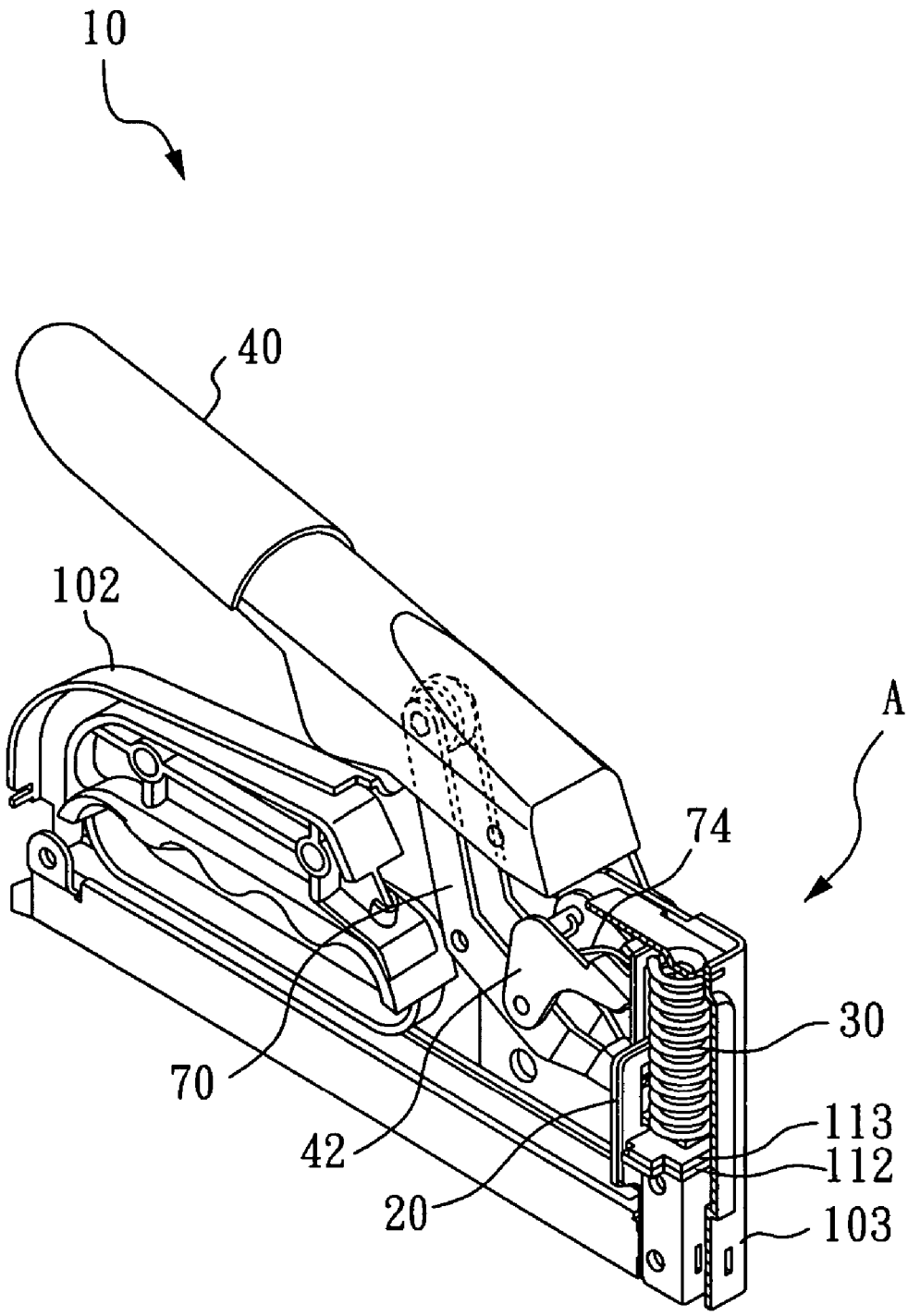
FIG. 1 is a perspective view of a staple gun according to a first embodiment of the present invention.
Figure 2:
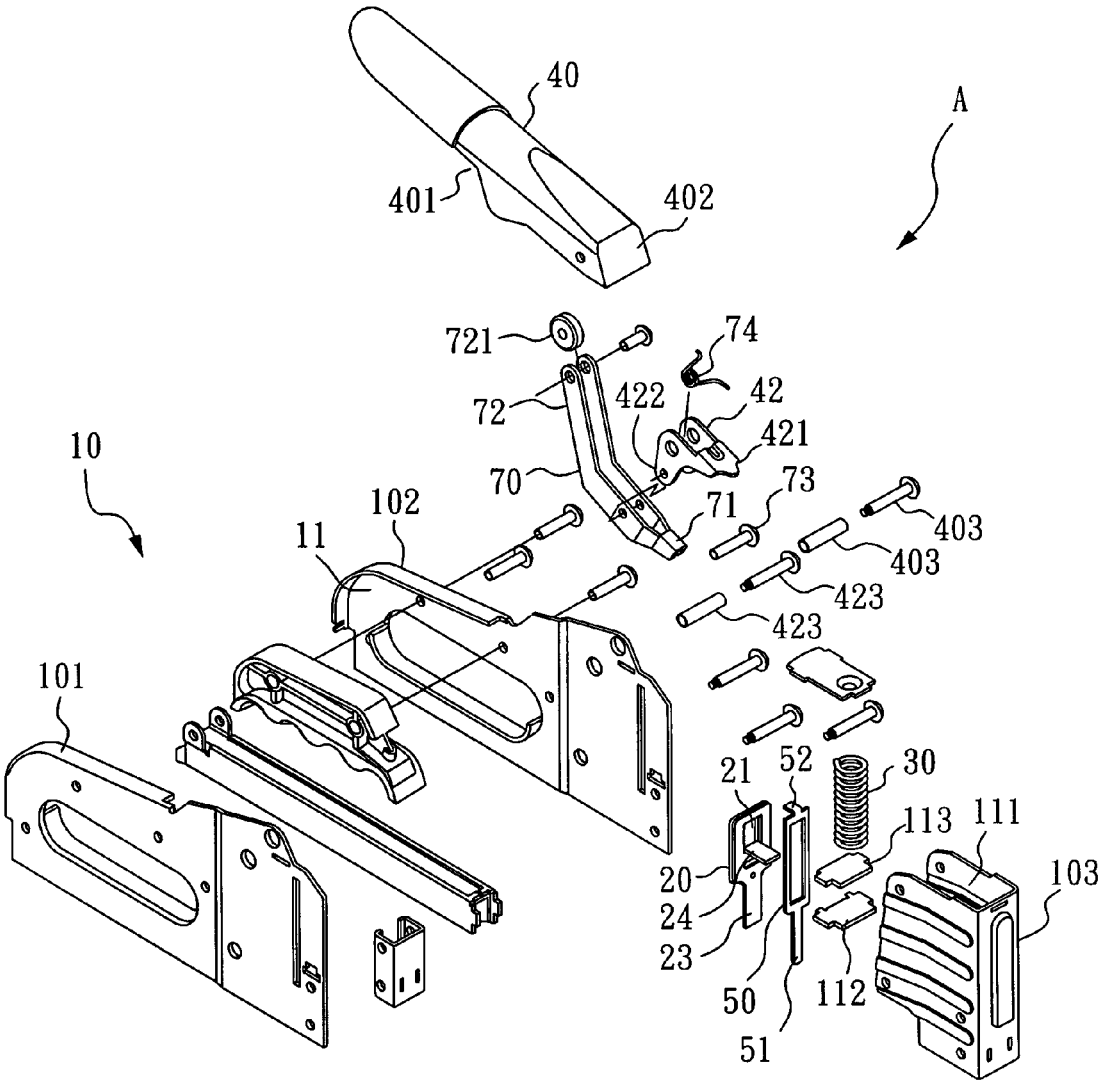
FIG. 2 is an exploded view of the staple gun according to the first embodiment of the present invention.
Figure 3:
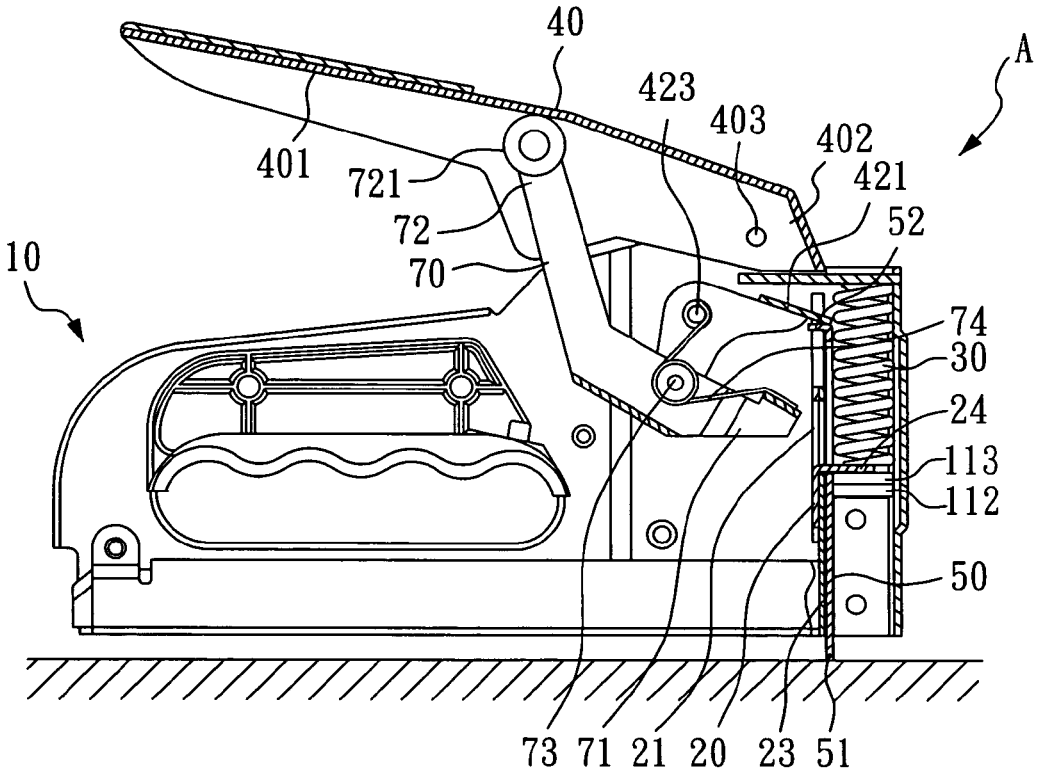
FIG. 3 is a sectional view of the staple gun according to the first embodiment of the present invention.

As shown in FIGS. 1, 2 and 3, the hand-held staple gun according to the first embodiment of the present invention comprises a housing 10, a driver 20, a spring means 30, a handle 40, and a safe actuation mechanism A.

The housing 10 includes a left side 101, a right side 102, and a front side 103. The housing 10 defines an internal space 11, where the internal space 11 includes an accommodation chamber 111. The spring means 30, being a compression spring, is positioned, in a compressed state, in the accommodation chamber 111, whereas the driver 20 and the safe actuation mechanism A are received in the internal space 11.

The driver 20 is formed with an opening 21 and a support 24 on which the spring means 30 is seated, and an impact portion 23 formed at the lower part of the driver 20. The spring means 30 provides the driver 20 a driving force so as to fire staples (not shown) at the impact portion 23. To reduce the shock and noise produced when firing of the staples, a plate 112, to which a buffer pad 113 is adhered, is firmly secured to the housing 10 in the accommodation chamber 111. The handle 40 is, at its front end, pivotally secured to the housing 10 with a pin 403.

The safe actuation mechanism A includes a swing means 42, a link 70, and an actuation control rod 50. The swing means 42 is pivotally secured to the housing 10 via a pin 423, and the link 70 is pivotally connected with a second end 422 of the swing means 42 with a pin 73, with a torsion spring 74 provided around the pin 73 where one end of the torsion spring 74 biases against the link 70 and another end of the torsion spring 74 against the swing means 42. The link 70 has a first end 71 positioning besides the opening 21 of the driver 20, and has a second end 72 mounted with a roller 721 so as to facilitate interaction of the handle 40 and the link 70 when the underside of the handle 40 presses against the second end 72 of the link 70. The actuation control rod 50 stretches, at a first end 51, out of the bottom of the housing 10, whereas a second end 52 of the actuation control rod 50 touches a first end 421 of the swing means 42 such that the actuation control rod 50 is biased by the elastic force of the torsion spring 74. The driver 20 is arranged such that it is spaced apart and paralleled with the actuation control rod 50.

Figure 4:
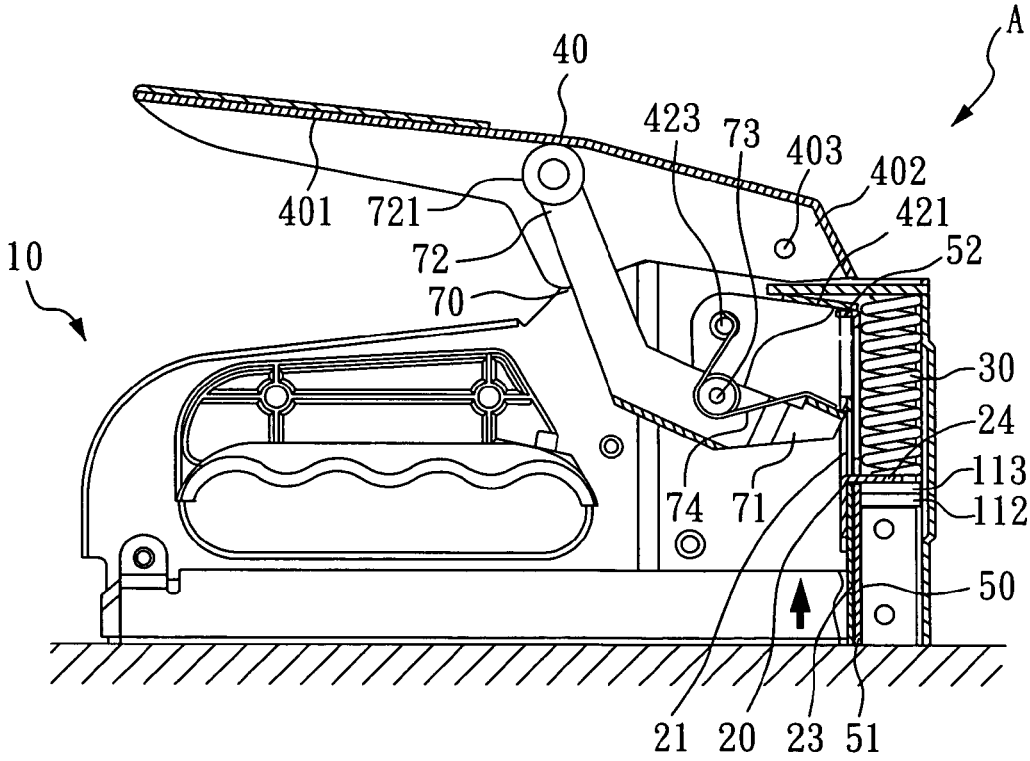
FIG. 4 is a sectional view of the first embodiment showing moving upward of an actuation control rod into a housing.

When the staple gun according to the first embodiment of the present invention is in use, the first end 71 of the link 70 cannot engage the driver 20 at the opening 21 even if the handle 40 is pressed down. As shown in FIG 4, when the user intends to operate the staple gun, the first end 51 of the actuation control rod 50 is pressed and moves upward into the housing 10, so that the second end 52 of the actuation control rod 50 pushes the first end 421 of the swing means 42, making the first end 71 of the link 70 overcome the torsion spring 74 and move rightward and thus engage the driver 20 at the opening 21.

Figure 5:
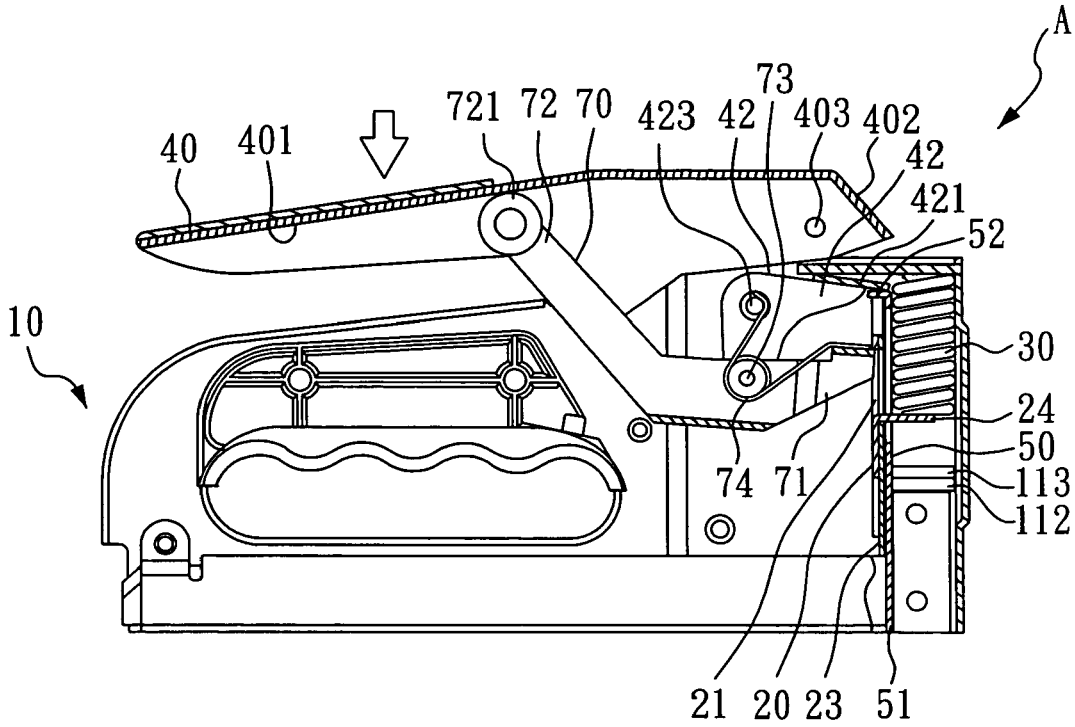
FIG. 5 is a sectional view of the first embodiment showing pressing down of a handle and moving upward of a driver urged by a link.
Figure 6:
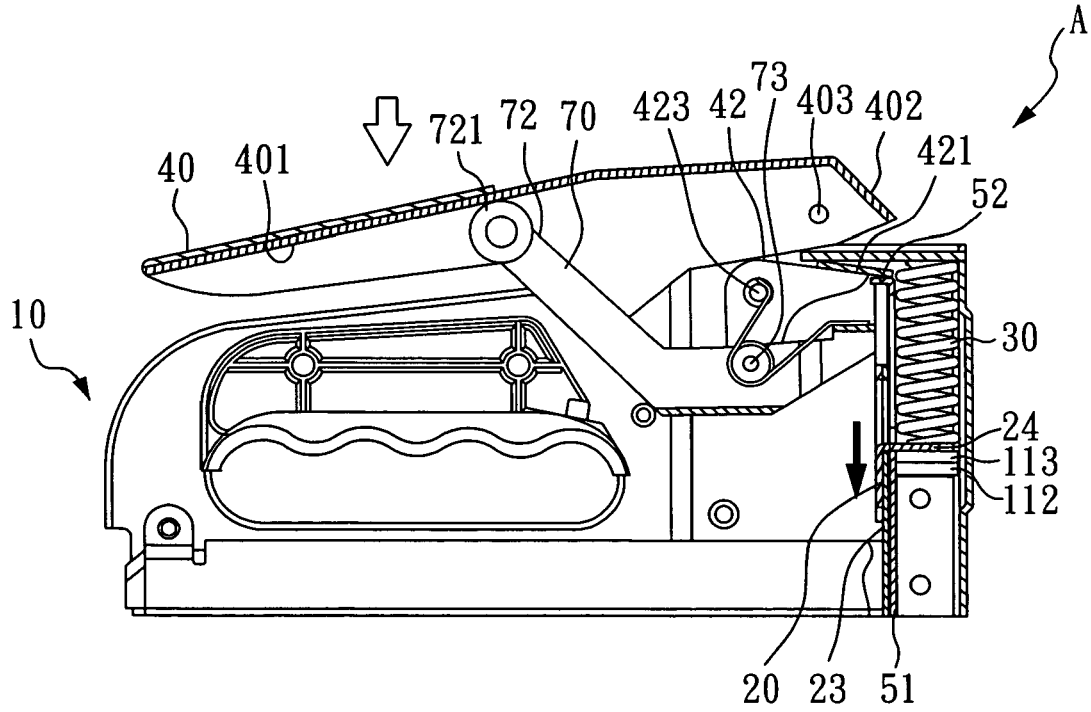
FIG. 6 is a sectional view of the first embodiment showing pressing down continuously of the handle and rushing downward of the driver after releasing from the link.
Figure 7:
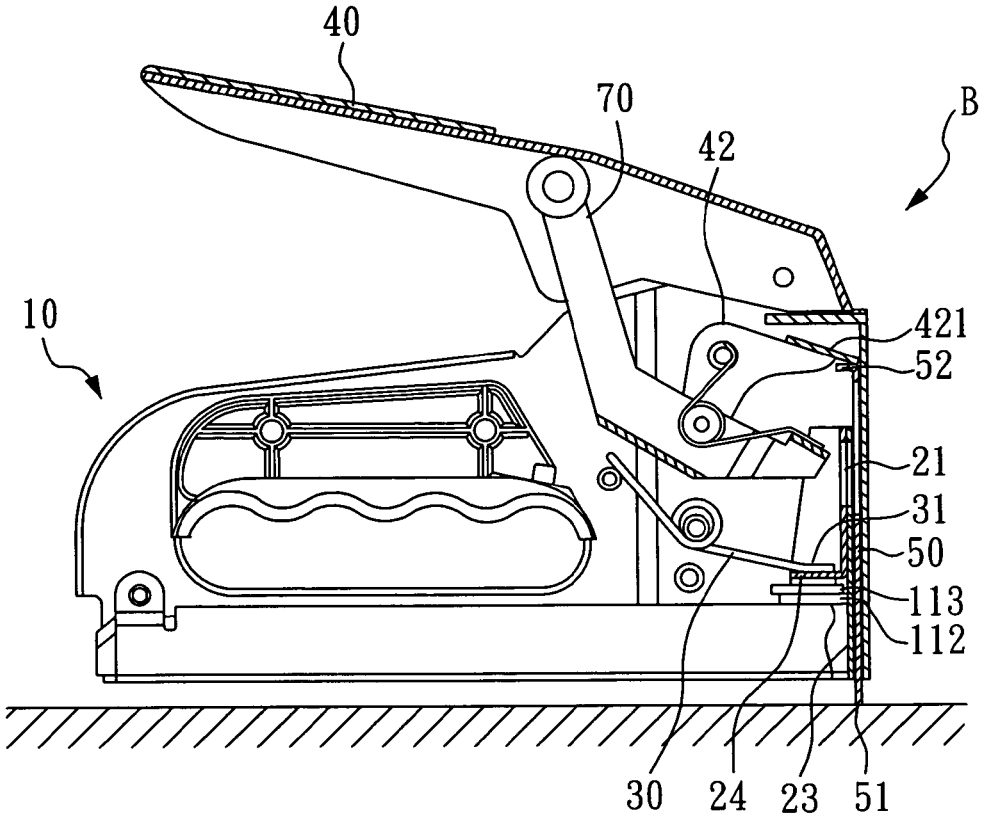
FIG. 7 is a sectional view of the staple gun according to a second embodiment of the present invention.
Figure 8:
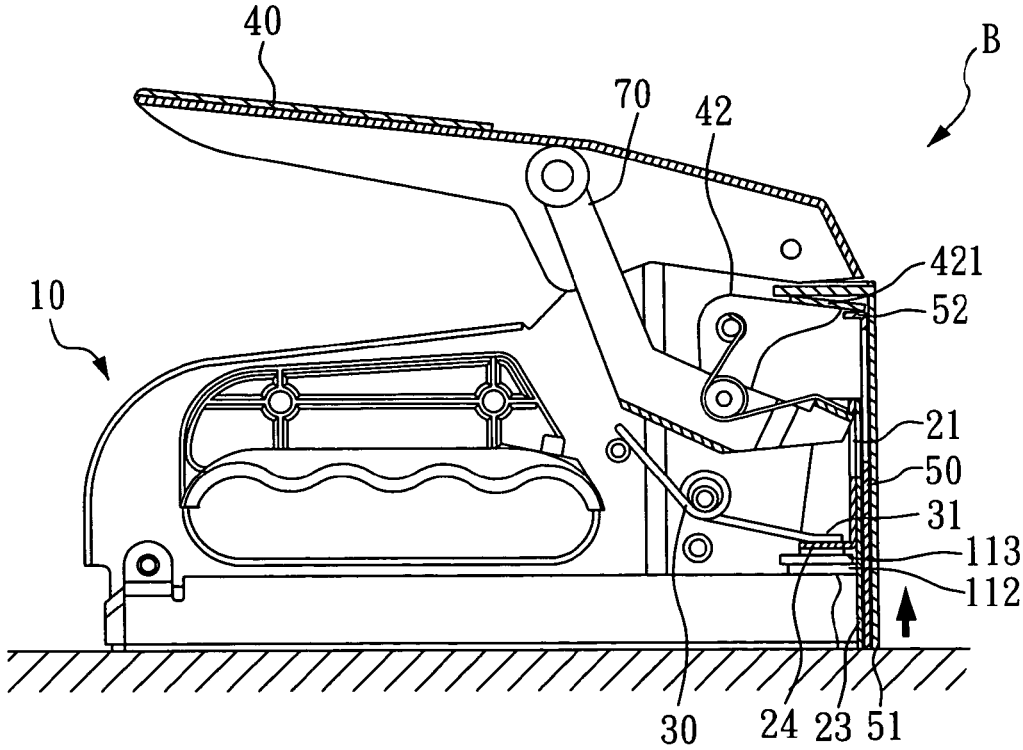
FIG. 8 is a sectional view of the second embodiment showing moving upward of an actuation control rod into a housing.
Figure 9:
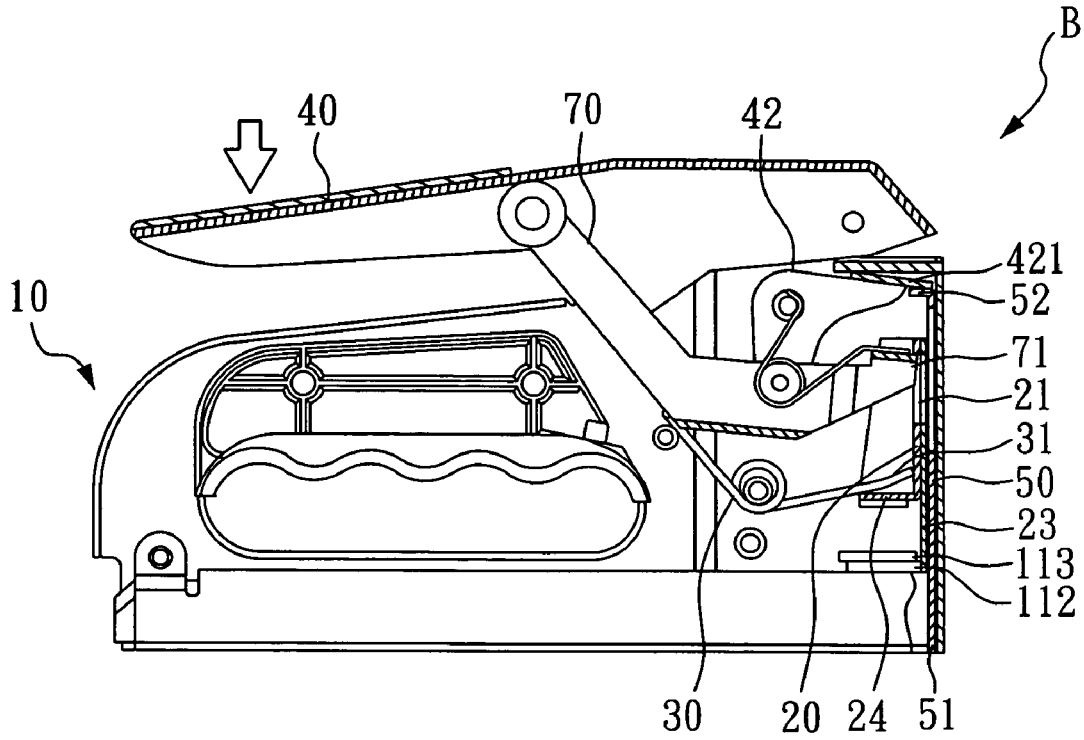
FIG. 9 is a sectional view of the second embodiment showing pressing down of a handle and moving upward of a driver urged by a link.
Figure 10:
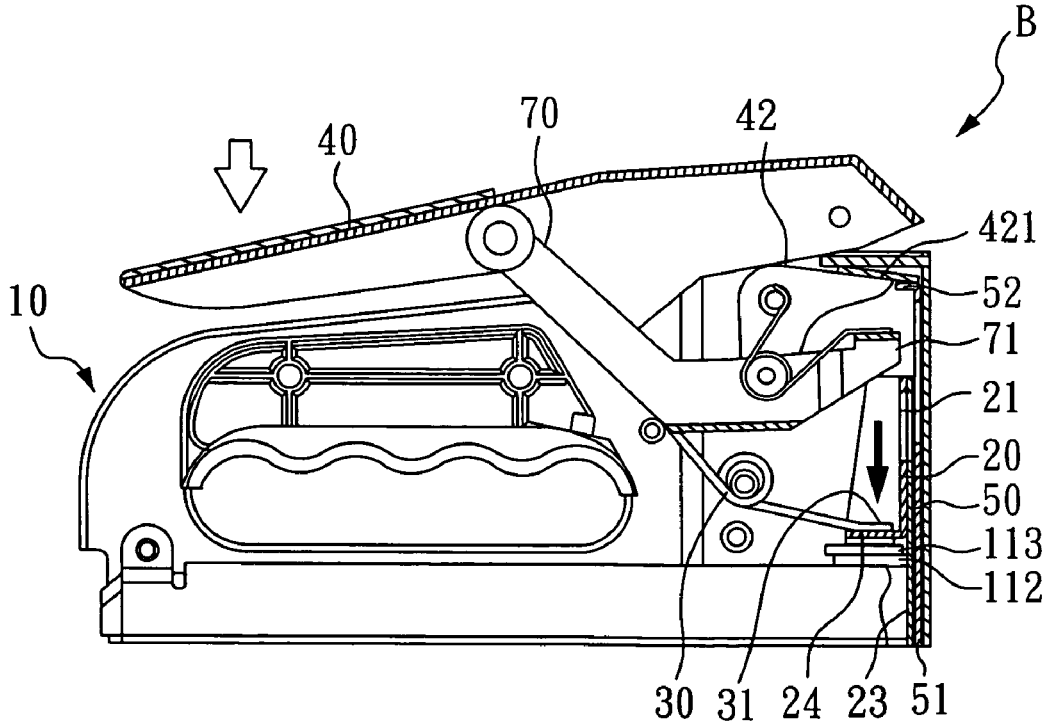
FIG. 10 is a sectional view of the second embodiment showing pressing down continuously of the handle and rushing downward of the driver after releasing from the link.
Figure 11:
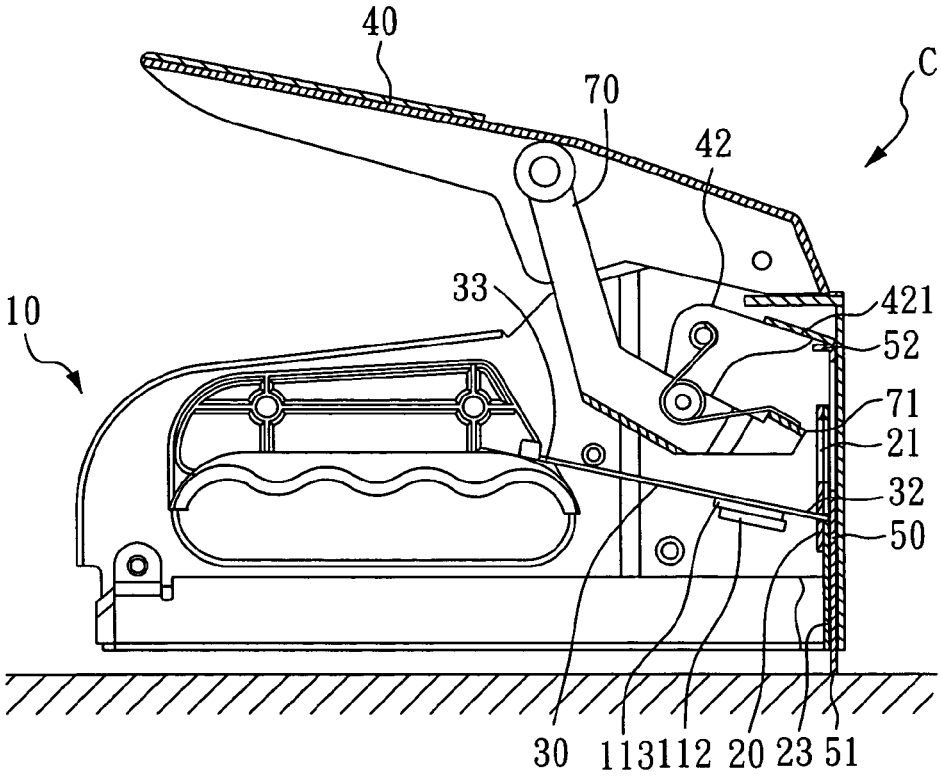
FIG. 11 is a sectional view of the staple gun according to a third embodiment of the present invention.
Figure 12:
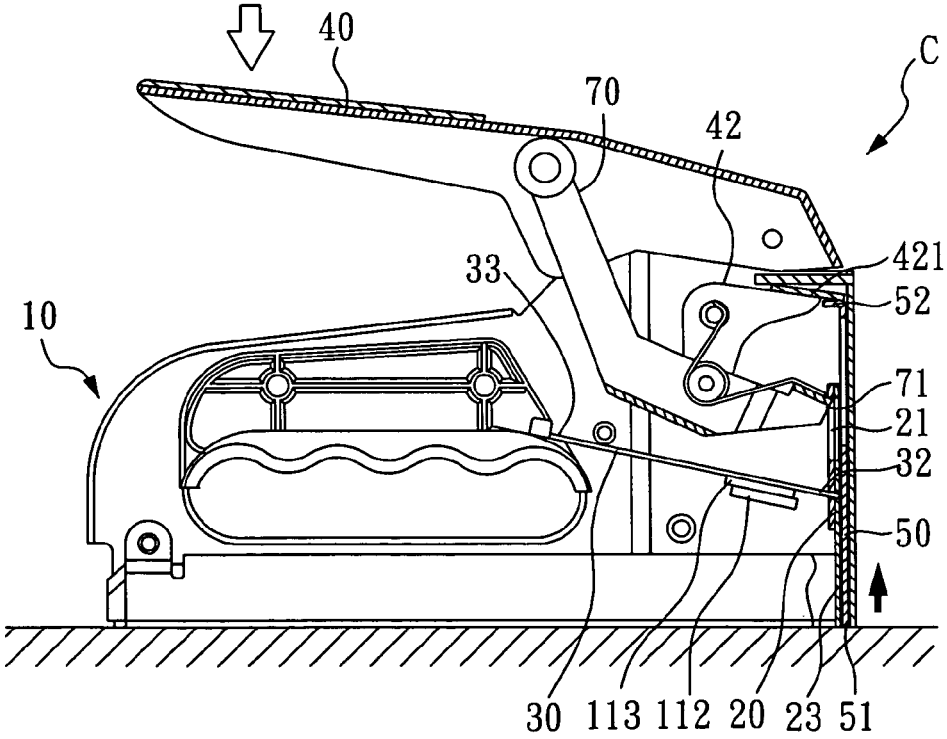
FIG. 12 is a sectional view of the third embodiment showing moving upward of an actuation control rod into a housing.
Figure 13:
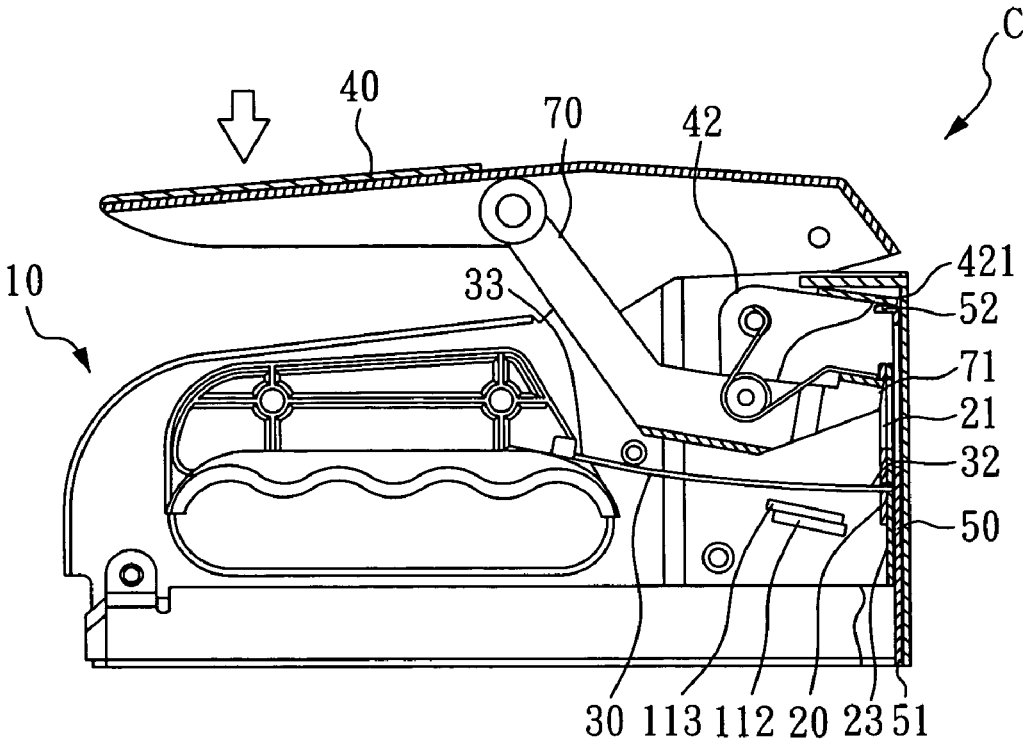
FIG. 13 is a sectional view of the third embodiment showing pressing down of a handle and moving upward of a driver urged by a link.
Figure 14:
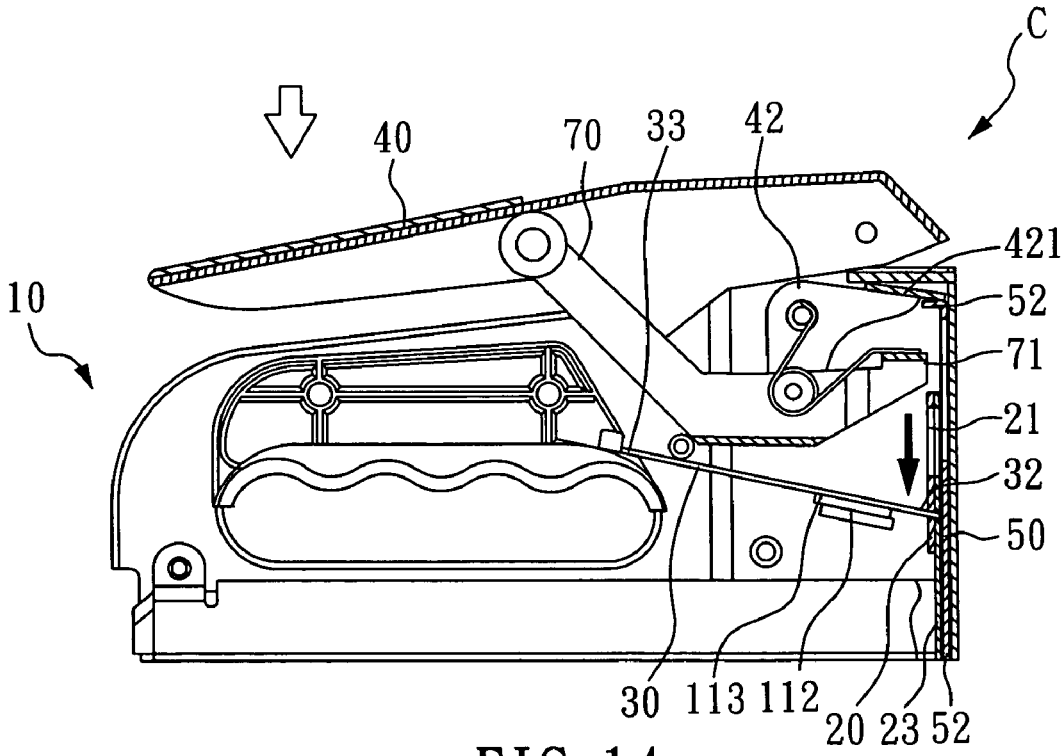
FIG. 14 is a sectional view of the third embodiment showing pressing down continuously of the handle and rushing downward of the driver after releasing from the link.

As shown in FIG. 5, when the user presses down the handle 40 so as to move upward the driver 20 and that the support 24 of the driver 20 presses against the spring means 30. When the handle 40 is pressed down continuously, the first end 71 of the link 70 releases abruptly from the opening 21 of the driver 20, making the driver 20 rush downward so as to drive staples out of the staple gun, through the help of the elasticity force of the spring means 30.

Referring to FIGS. 7 to 10, the second embodiment of the present invention, where a safe actuation mechanism B is similar to the safe actuation mechanism A of the first embodiment in structure and function, except for a different spring means 30, to be exact a torsion spring. The spring means 30 has a first end 31 pressing against the support 24 of the driver 20. A bottom plate 112 is firmly secured to the housing 10 and is provided underneath the support 24 of the driver 20, where a buffer pad 113 is interposed between the bottom plate 112 and the support 24.

Further referring to FIGS. 11 to 14, the third embodiment of the present invention, where a safe actuation mechanism C is similar to the safe actuation mechanism A of the first embodiment in structure and function, except for a different spring means 30, a leaf spring. The spring means 30 has a first end 32 affixed on the driver 20 and a second end 33 secured to the housing 10. Also, for the purpose of reducing the shock and noise produced, a bottom plate 112 is firmly secured to the housing 10 and is provided underneath the spring means 30, where a buffer pad 113 is interposed between the bottom plate 112 and the spring means 30.

Figure 15:
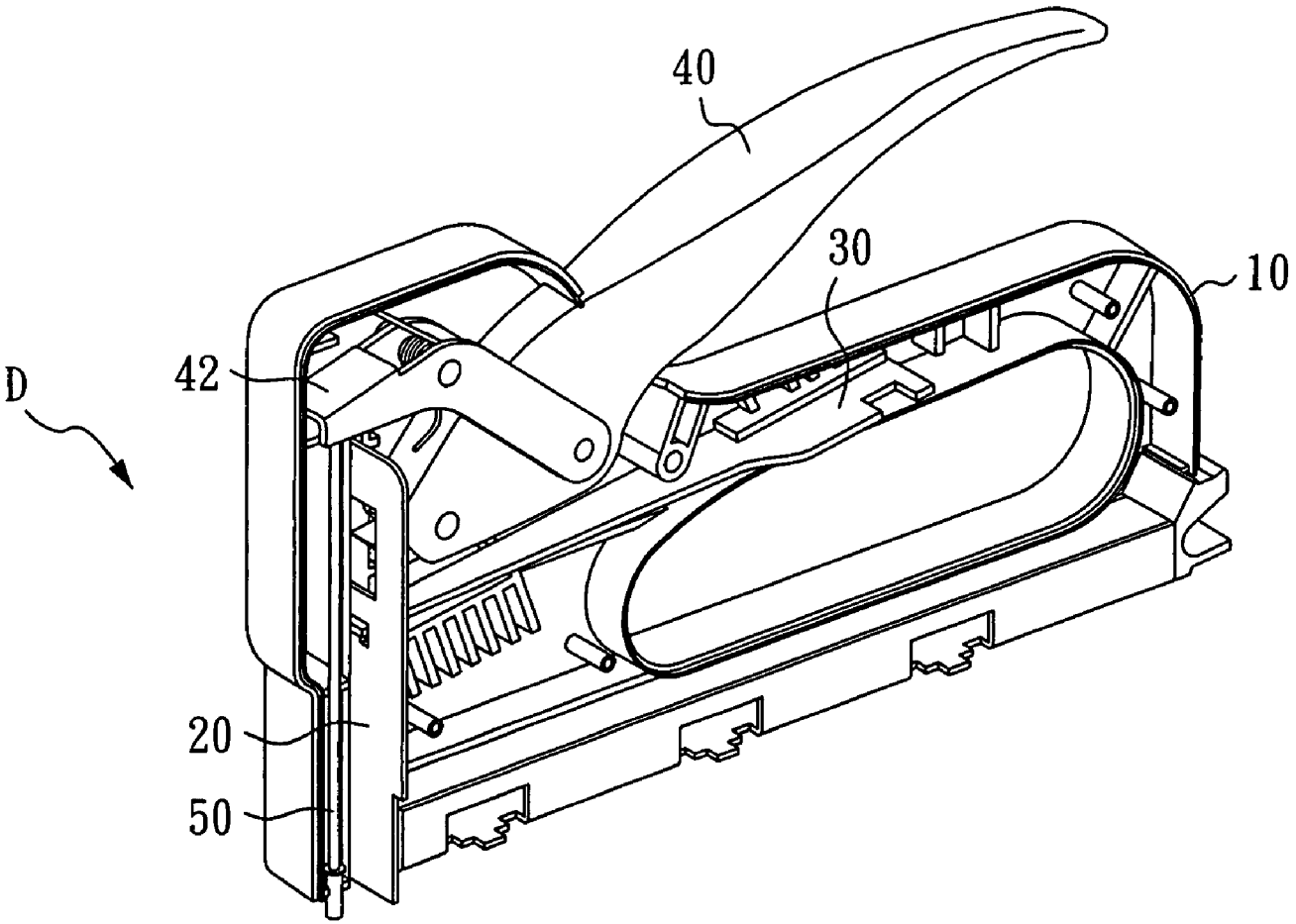
FIG. 15 is a perspective view of a staple gun according to a fourth embodiment of the present invention.
Figure 16:
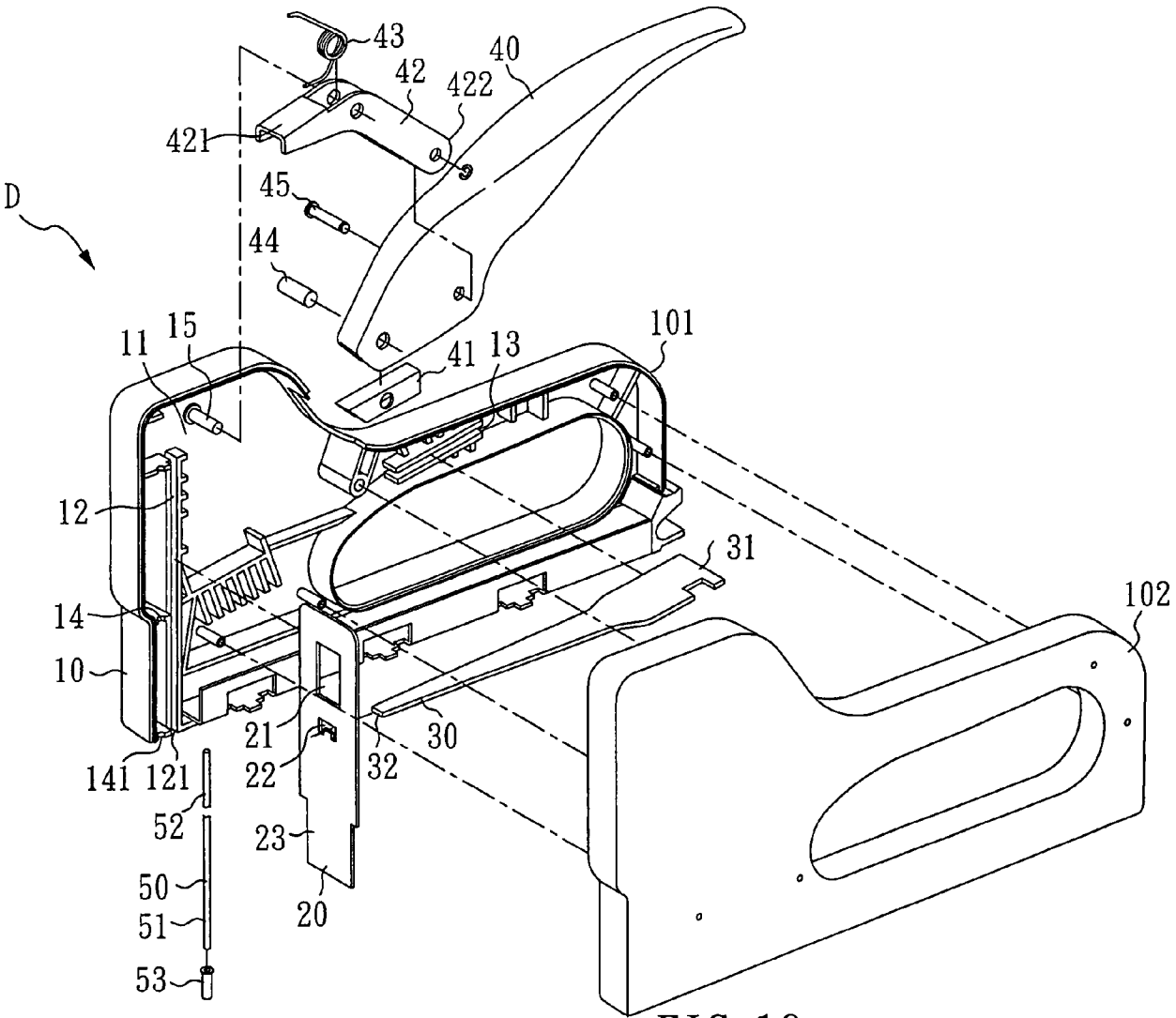
FIG. 16 is an exploded view of the staple gun according to the fourth embodiment of the present invention.
Figure 17:
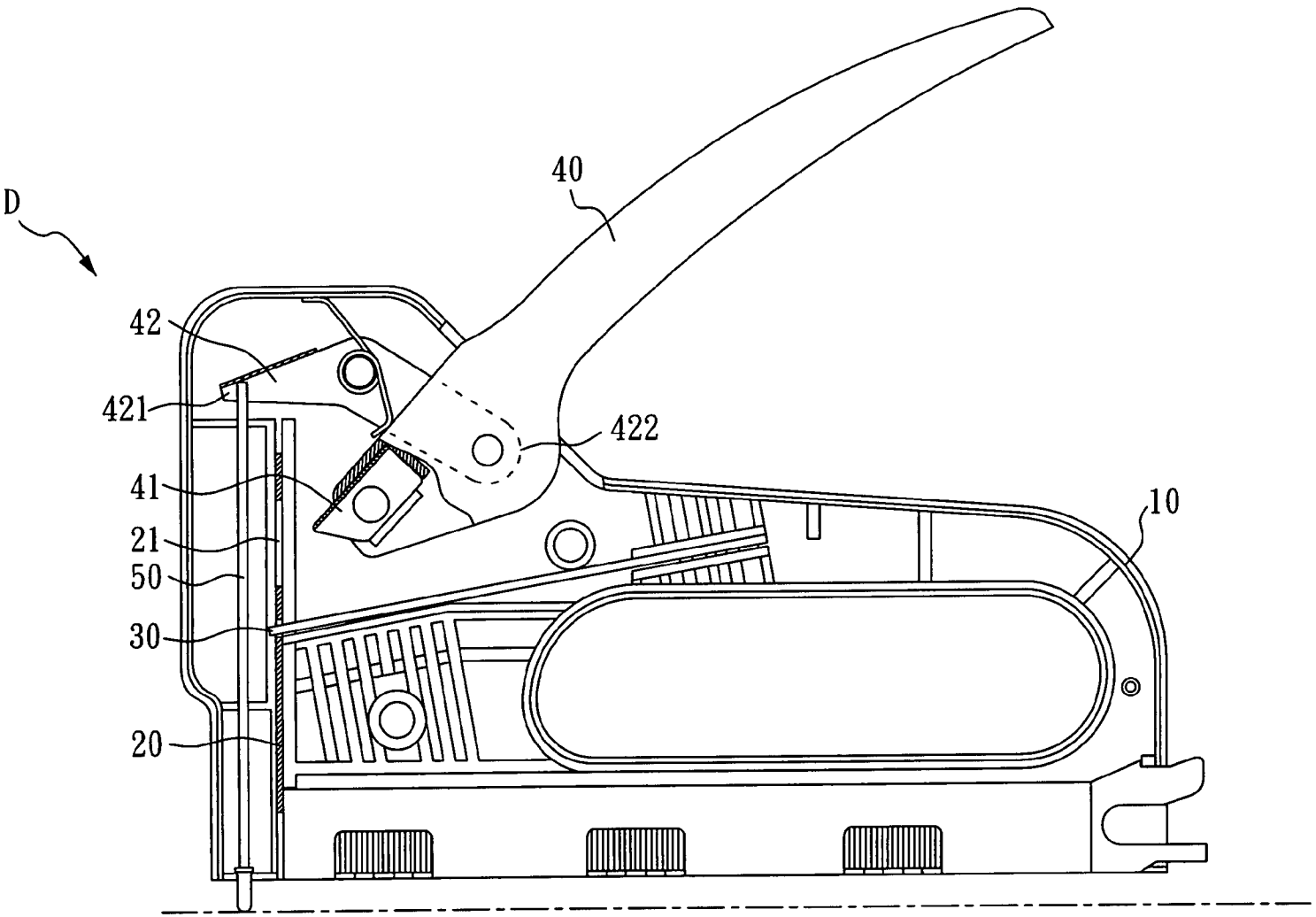
FIG. 17 is a sectional view of the staple gun according to the fourth embodiment of the present invention.

A fourth embodiment of the present invention, as shown in FIGS. 15 to 17, discloses a hand-held staple gun having a similar inventive concept and function with those of the embodiments above mentioned, though there are differences in terms of structure.

The hand-held staple gun according to the fourth embodiment of the present invention comprises a housing 10, a driver 20, a spring means 30, a handle 40, and a safe actuation mechanism D. The housing 10 includes a left side 101, a right side 102, a first chute 12 having an outlet 121, and a second chute 14 having an outlet 141, where the left side 101 and the right side 102 define an internal space 11. The driver 20 is formed with an opening 21, an engaging hole 22, and an impact portion 23 at the lower part of the driver 20. The driver 20 is movably received in the first chute 12, with the impact portion 23 extending outward from the outlet 121. The spring means 30 has a first end 31 and a second end 32, where the first end 31 is received and fixed in a recess 13 of the housing 10 and the second end 32 is received in the engaging hole 22 of the driver 20.

The safe actuation mechanism D includes a swing means 42, a hook 41, and an actuation control rod 50. The actuation control rod 50 is movably disposed in the second chute 14. The swing means 42 is pivotally secured to the housing 10 via a pin 15, and has a first end 421 and a second end 422, with a torsion spring 43 coaxially fixed, on the housing 10, with the swing means 42 and provided around the pin 15, where one end of the torsion spring 43 biases against the housing 10 and another end against the handle 40. The handle 40 is pivotally secured to the swing means 42 via a pin 45 at the second end 422. The hook 41 is fixed to the handle 40 via a pin 44 and has a front end adjacent to the opening 21 of the driver 20. The actuation control rod 50 stretches downward, at a first end 51, and out of the outlet 141 of the second chute 141, whereas a second end 52 of the actuation control rod 50 touches the first end 421 of the swing means 42 such that the actuation control rod 50 is biased by the elastic force of the torsion spring 43. The first end 51 of the actuation control rod 50 is sleeved with a cap 53.

Figure 18:
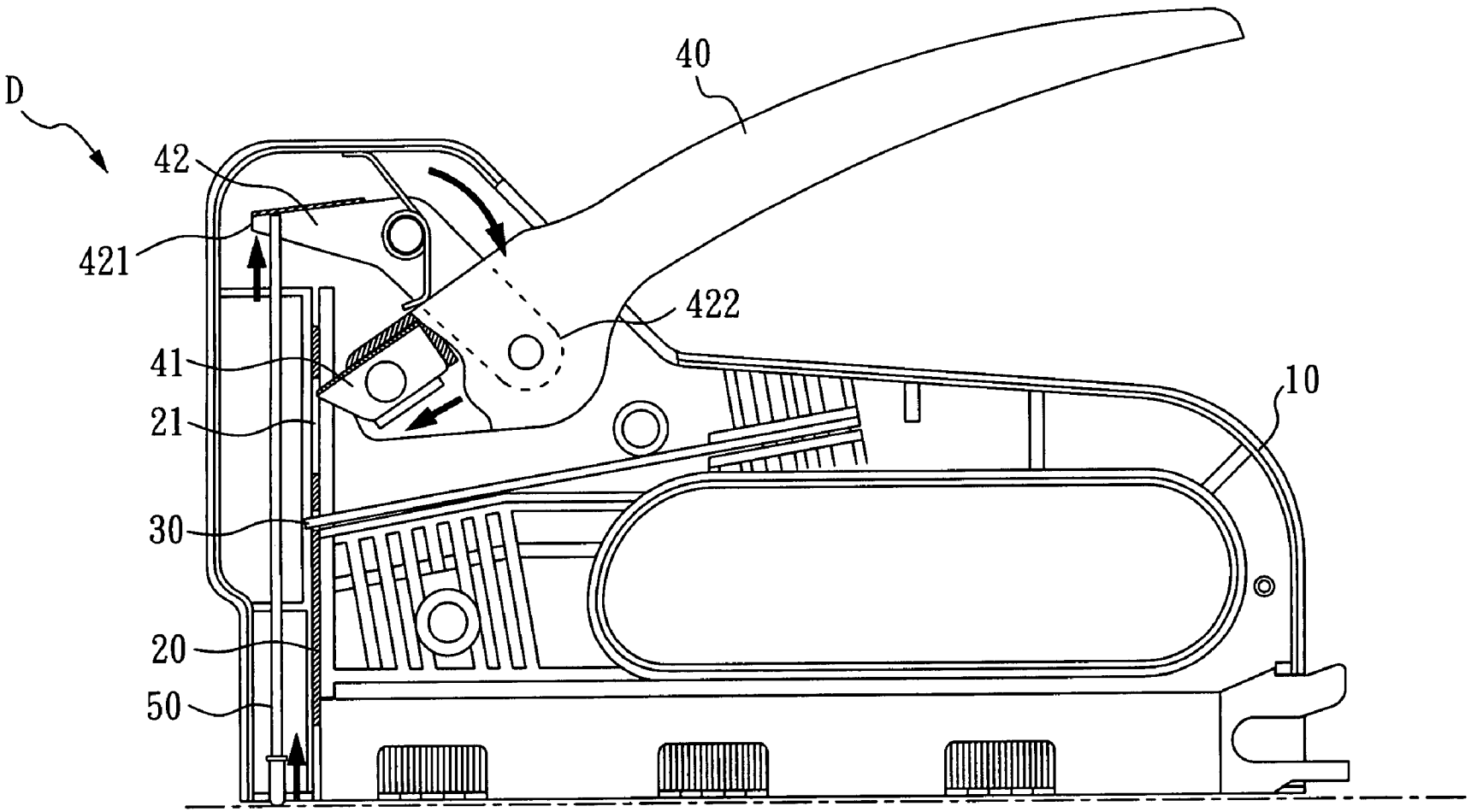
FIG. 18 is a sectional view of the fourth embodiment showing moving upward of an actuation control rod into a housing.
Figure 19:
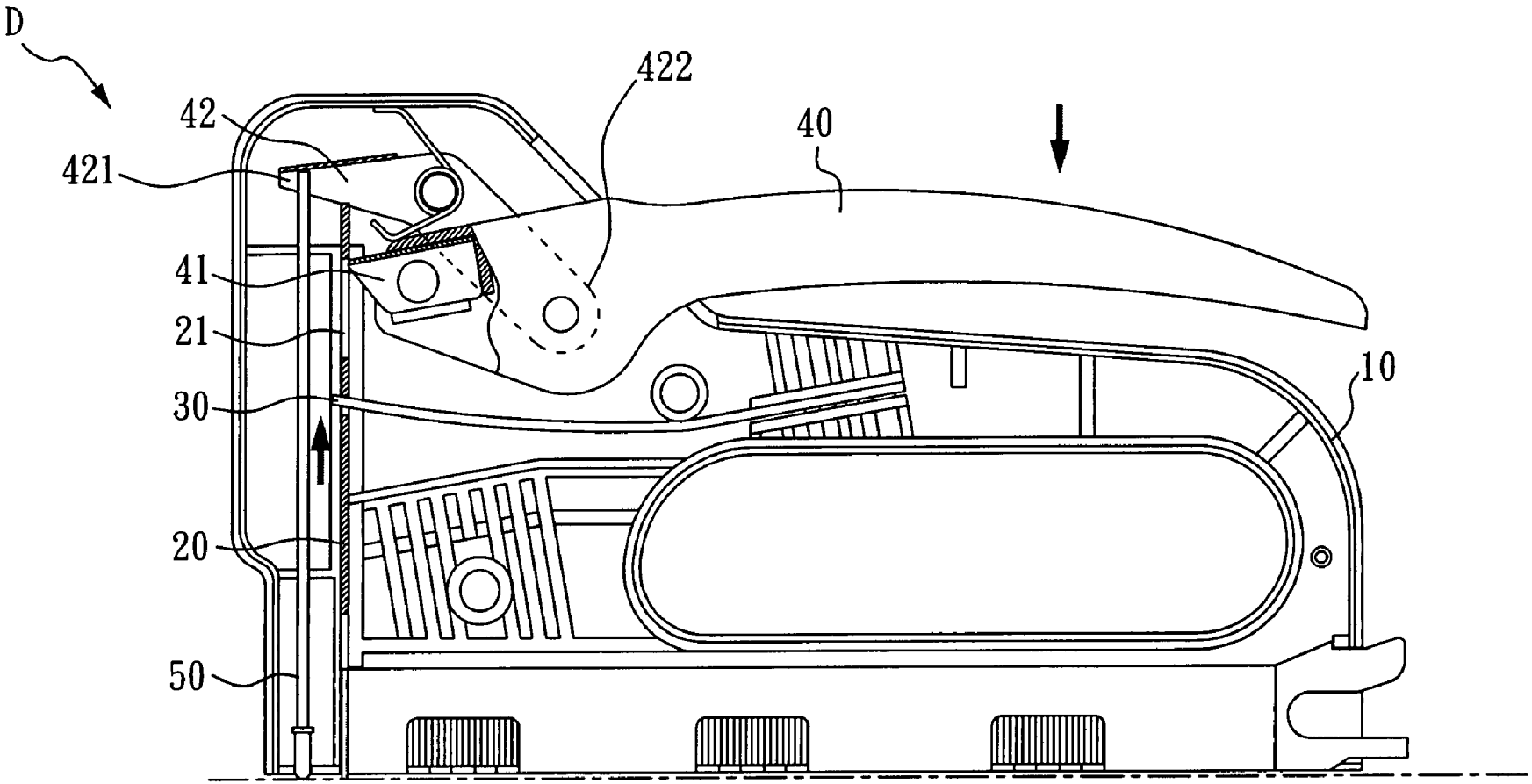
FIG. 19 is sectional view of the fourth embodiment showing pressing down of a handle and moving upward of a driver urged by a hook.
Figure 20:
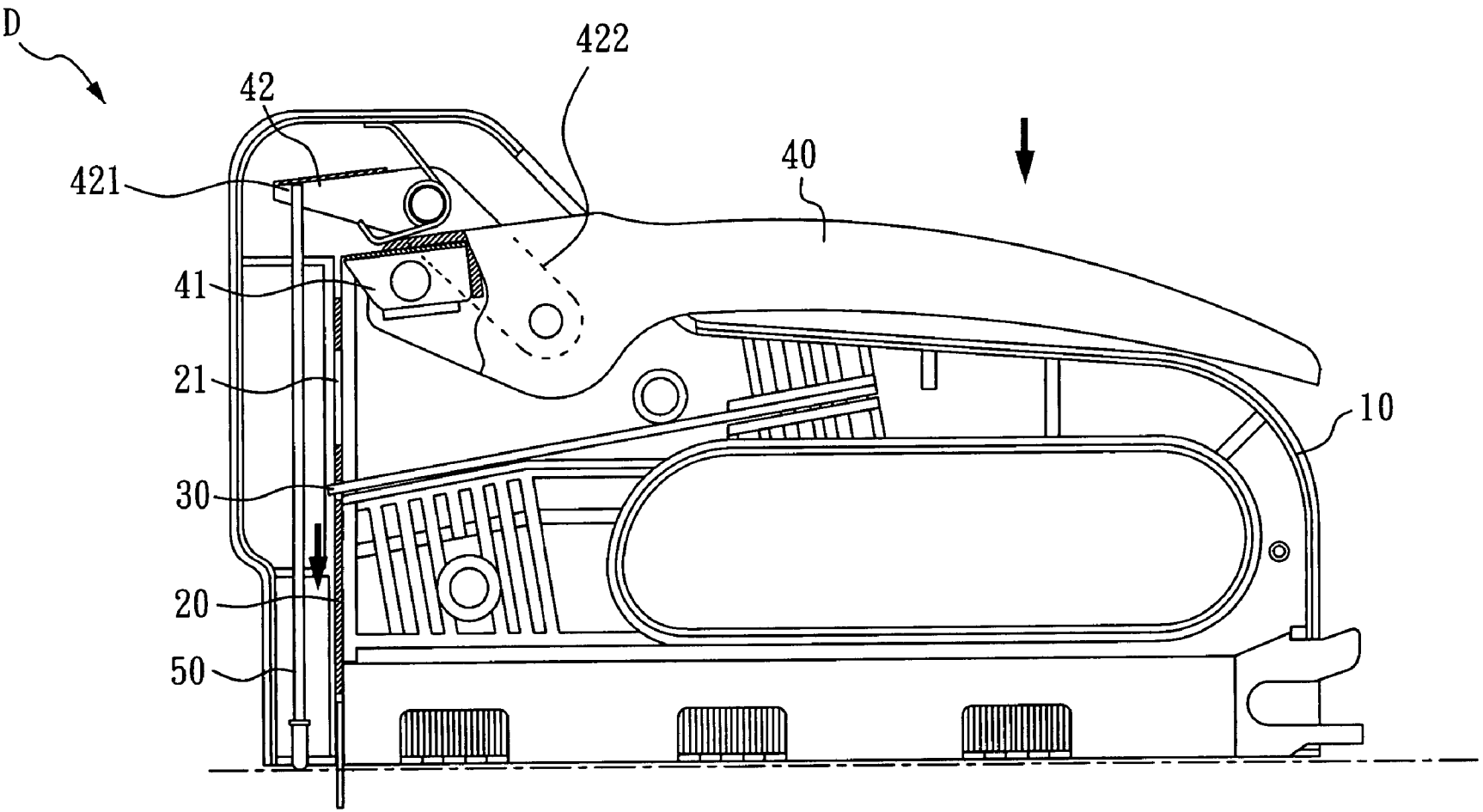
FIG. 20 is a sectional view of the fourth embodiment showing pressing down continuously of the handle and rushing downward of the driver after releasing from the hook.

As shown in FIGS. 18 to 20, when the first end 51 of the actuation control rod 50 is pressed and retracts into the second chute 14, the second end 52 of the actuation control rod 50 pushes upward the first end 421 of the swing means 42, so that the second end 422 of the swing means 42 rotates and pulls the handle 40 to advance a small distance, making the hook 41 engage the driver 20 at the opening 21. When the handle 40 is pressed down so as to move upward the driver 20 and that the support 24 of the driver 20 presses against the spring means 30. When the handle 40 is pressed down continuously, the handle 40, through the hook 41 into the opening 21 of the driver 20, raises the driver 20, and deforms the spring means 30, and then releases from the opening 21 abruptly, making the driver 20 rushes downward so as to drive staples out of the staple gun, with the help of the elastic force of the spring means 30.

Figure 21:
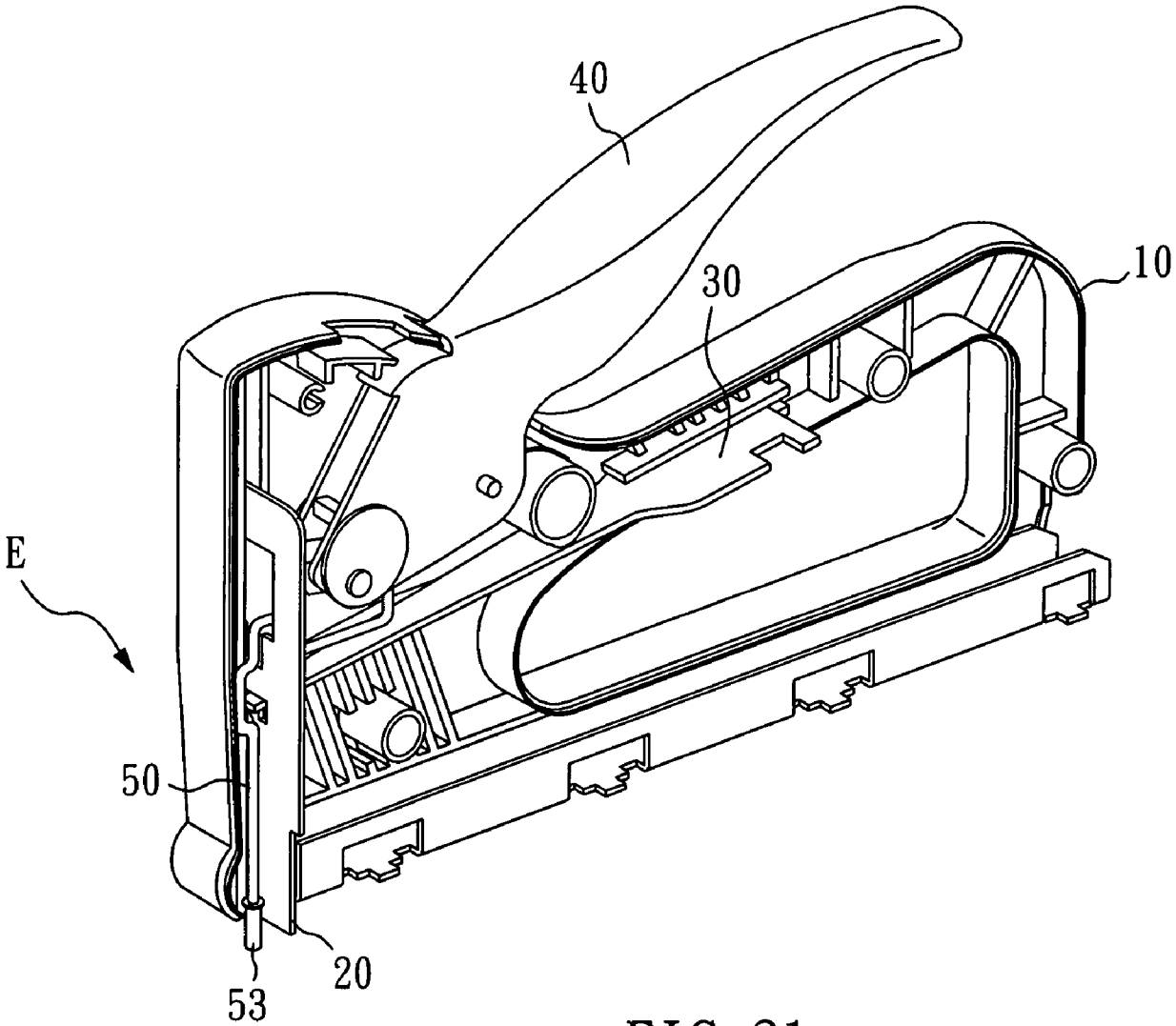
FIG. 21 is a perspective view of a staple gun according to a fifth embodiment of the present invention.
Figure 22:
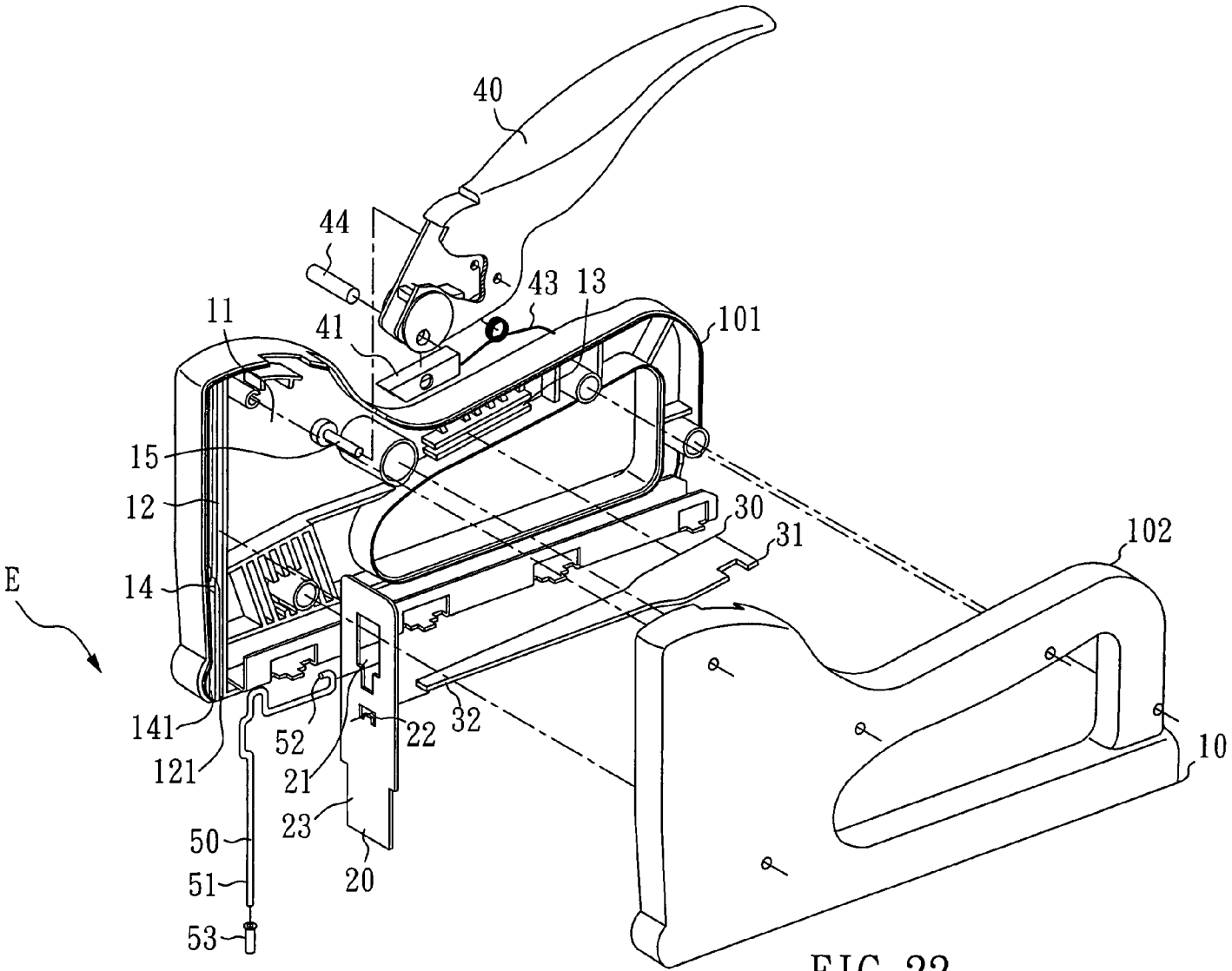
FIG. 22 is an exploded view of the staple gun according to the fifth embodiment of the present invention.
Figure 23:
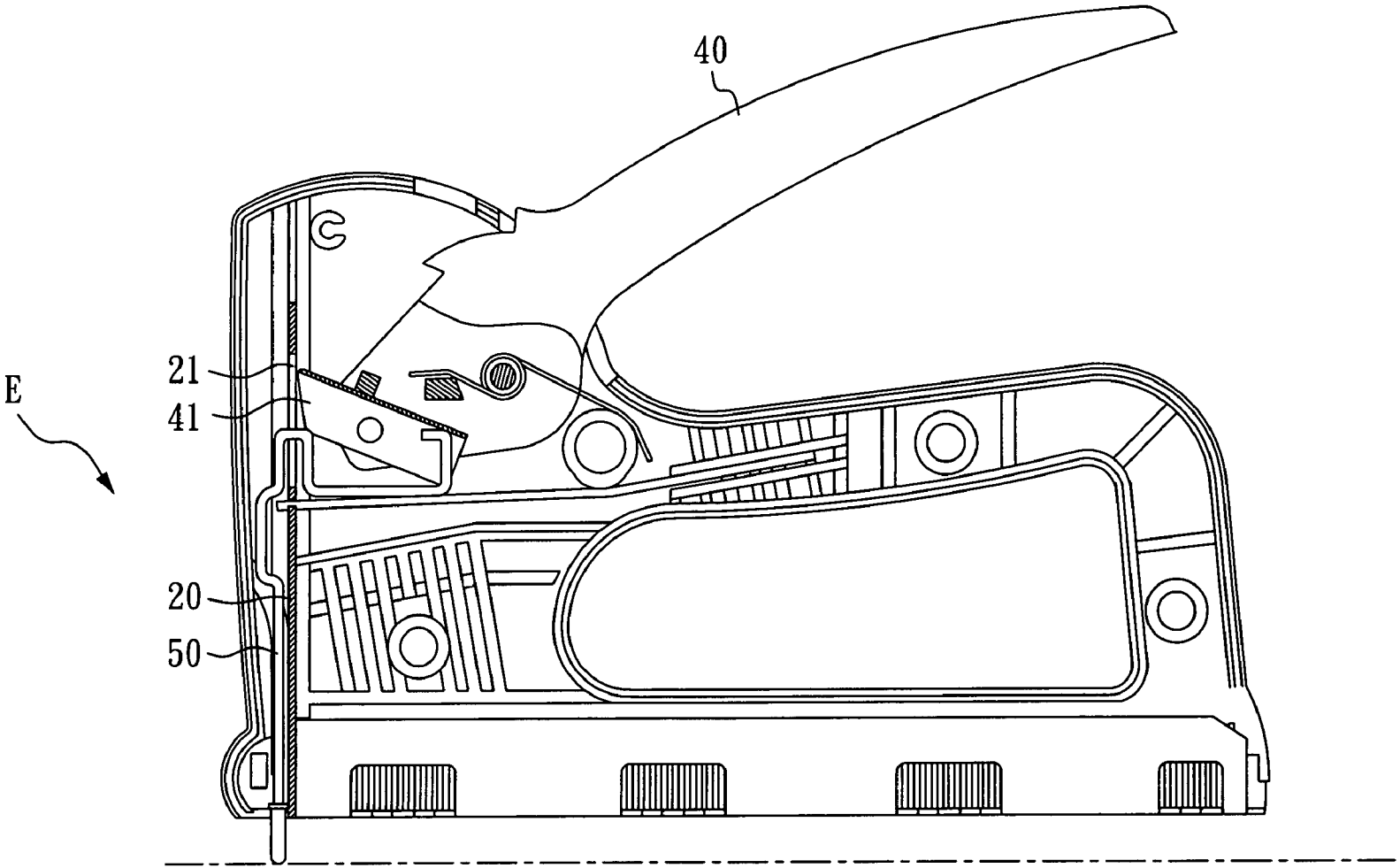
FIG. 23 is a sectional view of the staple gun according to the fifth embodiment of the present invention.
Figure 24:
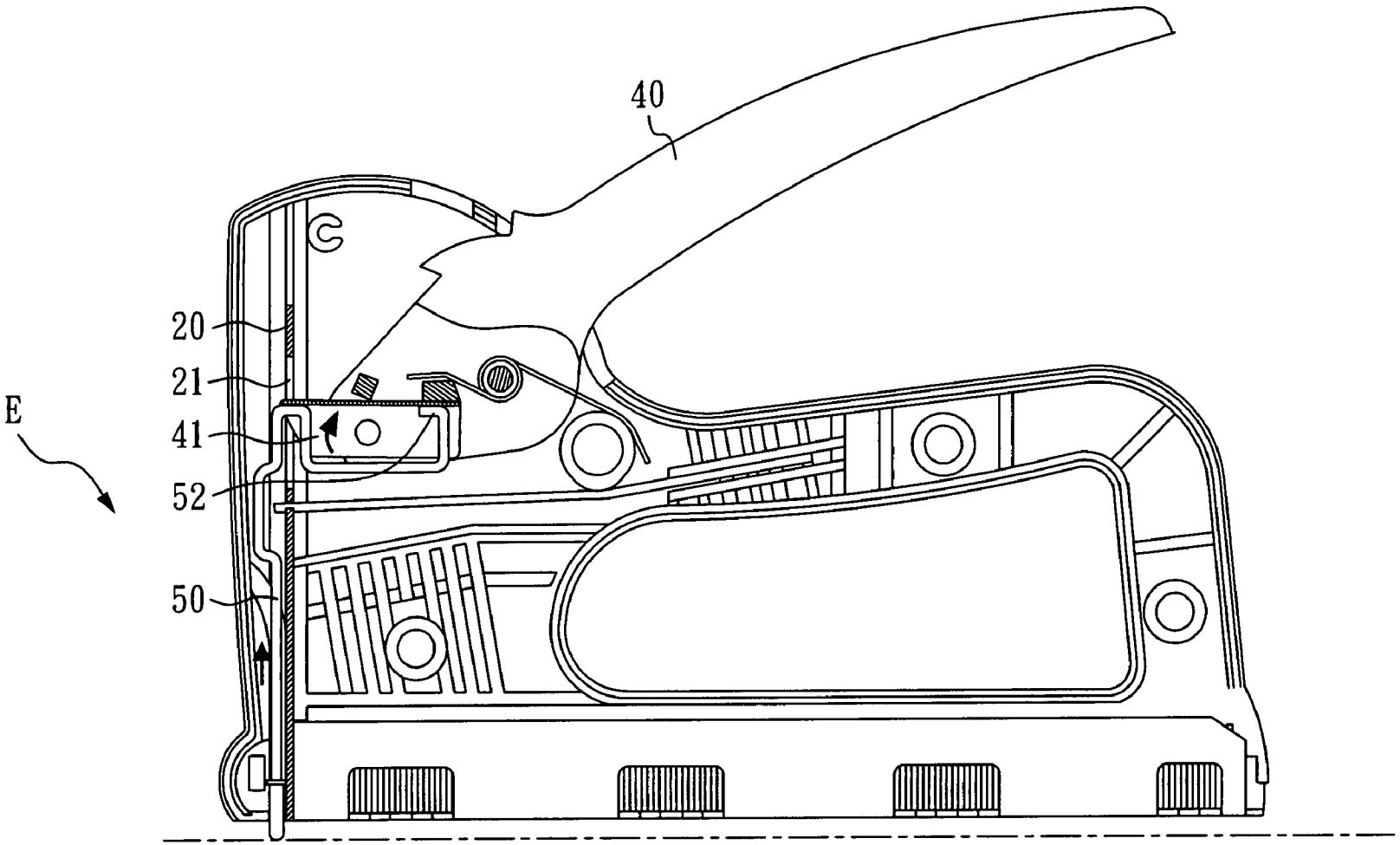
FIG. 24 is a sectional view of the fifth embodiment showing moving upward of an actuation control rod into a housing.
Figure 25:
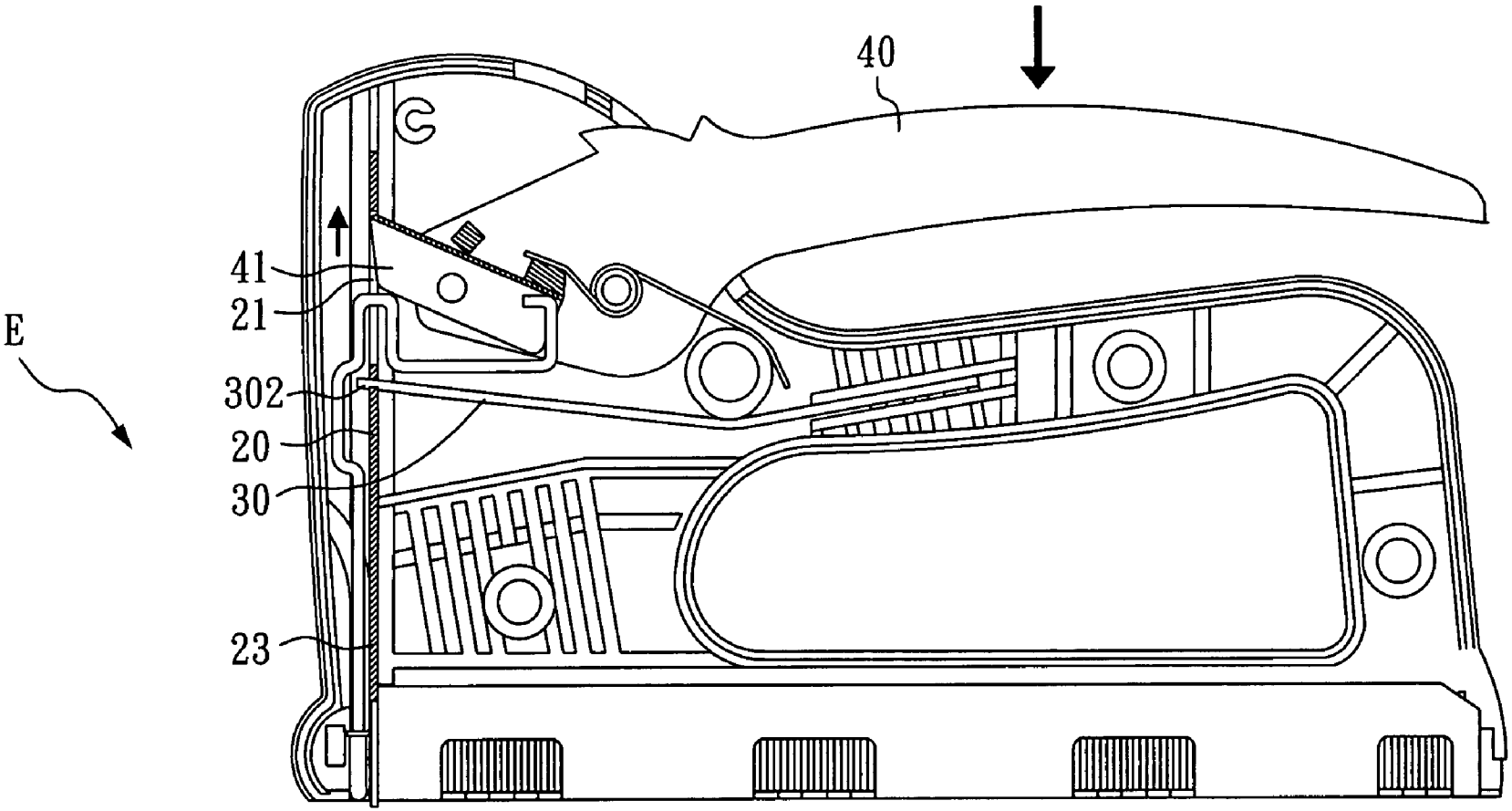
FIG. 25 is sectional view of the fifth embodiment showing pressing down of a handle and moving upward of a driver urged by a hook.

Further, as shown in FIGS. 21 to 23, a hand-held staple gun having a similar inventive concept and function with those of the fourth embodiment shown in FIGS. 15 to 20 (but without the swing means 42), according to the fifth embodiment of the present invention, is also disclosed. A handle 40 is pivotally secured to a housing 10 via a pin 15 fixed on the housing 10, with a torsion spring 43 coaxially fixed, on the housing 10, with the handle 40 and sleeved on the pin 15, where one end of the torsion spring 43 presses on the housing 10 and another end on the handle 40. An actuation control rod 50 of a safe actuation mechanism E is formed of an L shape, including a vertical end 51, sleeved with a cap 53, movably disposed in and stretching downward out of an outlet 141 of a second chute 14 of the housing 10, and a horizontal end 52 abutting on a rear end of a hook 41, where the hook 41 is pivotally secured to the handle 40 via a pin 44 such that the actuation control rod 50 is biased by the elastic force of the torsion spring 43. When the horizontal end 52 of the actuation control rod 50 pushes the rear end of and rotate the hook 41 making the front end of the hook 41 move into an opening 21 of a driver 20 (see FIG. 24), where the driver 20 is movably received in a first chute 12 of the housing 10. By pressing down of the handle 40, the driver 20 is raised (FIG. 25), and a spring means 30 biasing on the driver 20 is deformed. The spring means 30 has a first end 31 received and fixed in a recess 13 of the housing 10 and a second end 32 received in an engaging hole 22 of the driver 20. Then the front end of the hook 41 releases abruptly from the opening 21 of the driver 20 and makes the driver 20 rushing downward, with an impact portion 23 at the lower part of the driver 20 driving staples out of the staple gun by the elastic force of the spring means 30 (not shown).

Although the present invention has been explained in relation to its preferred embodiments, it is to be understood that many other possible modifications and variations can be made without departing from the scope of the invention as hereinafter claimed.

What is claimed is:

1. A hand-held staple gun, comprising:

a housing, including a left side, a right side and a front side, and defining an internal space which includes an accommodation chamber;

a safe actuation mechanism, including a swing means, a link and an actuation control rod, wherein the swing means is pivotally secured to the housing, the link is pivotally connected with the swing means, the swing means and the link are biased by a torsion spring, and the actuation control rod has a first end stretching downward and out of the housing and has a second end pushing upward and touching the swing means such that the actuation control rod is biased by the elastic force of the torsion spring;

a driver, being movably disposed in the internal space of the housing and spaced apart from and paralleled with the actuation control rod of the safe actuation mechanism, and being driven out of the housing by an elastic force;

a spring means, being disposed on the driver so as to provide the driver the elastic force and thus fire staples; and a handle, being pivotally secured to the housing and activating the link when pressing down of the handle;

whereby, when the staple gun is not in use, the link cannot engage the driver even if the handle is pressed down, and when the staple gun is in use, the actuation control rod is pressed upward into the housing, so that the actuation control rod pushes the swing means, making the link engage the driver, where the driver, being biased by the spring means, is moved upward when the handle is pressed down, and when the handle is pressed down continuously, the link releases abruptly from the driver, making the driver rush downward so as to drive the staples out of the staple gun, through the help of the elasticity force of the spring means.

2. The hand-held staple gun as claimed in claim 1, wherein the driver is formed with an opening and a support on which the spring means is seated.

3. The hand-held staple gun as claimed in claim 1, wherein the spring means is a compression spring.

4. The hand-held staple gun as claimed in claim 3, wherein the spring means is positioned, in a compressed state, in the accommodation chamber.

5. The hand-held staple gun as claimed in claim 1, wherein a plate, to which a buffer pad is adhered, is firmly secured to the housing in the accommodation chamber.

6. The hand-held staple gun, as claimed in claim 1, wherein the link of the safe actuation mechanism has a first end positioning besides the opening of the driver and has a second end mounted with a roller.

7. The hand-held staple gun, as claimed in claim 1, wherein the spring means is a torsion spring, having a first end pressing against the support of the driver.

8. The hand-held staple gun, as claimed in claim 7, wherein a bottom plate is secured to the housing and is provided underneath the support of the driver, where a buffer pad is interposed between the bottom plate and the support.

9. The hand-held staple gun, as claimed in claim 1, wherein the spring means is a leaf spring, having a first end affixed on the driver and a second end secured to the housing.

10. The hand-held staple gun, as claimed in claim 9, wherein a bottom plate is secured to the housing and is provided underneath the spring means, where a buffer pad is interposed between the bottom plate and the spring means.

11. A hand-held staple gun, comprising:

a housing, including a left side, a right side, a first chute having an outlet, and a second chute having an outlet;

a safe actuation mechanism, including a swing means having a first end and a second end, a hook, and an actuation control rod having a first end and a second end, wherein the swing means is pivotally secured to the housing, and the actuation control rod is movably disposed in the second chute, such that a first end stretches downward and out of the outlet of the second chute of the housing and a second end touches the first end of the swing means such that the actuation control rod is biased by the elastic force of a torsion spring coaxially fixed on the housing with the swing means;

a driver being movably received in the first chute of the housing and spaced apart and paralleled with the actuation control rod of the safe actuation mechanism and being driven out of the outlet of the first chute by an elastic force;

a spring means, having a first end fixed in the housing, and having a second end engaging the driver; and a handle, being pivotally secured to the swing means at the second end of the swing means, and the hook being fixed to the handle, with a front end of the hook adjacent to the driver and activating the driver when pressing down of the handle, and the torsion spring with one end biasing the housing and with another end biasing the handle;

whereby, when the staple gun is not in use, the hook cannot engage the driver even if the handle is pressed down, and when the staple gun is in use, the actuation control rod is pressed upward into the second chute, so that the actuation control rod pushes the swing means, making the hook engage the driver, where the driver, being biased by the spring means, is moved upward when the handle is pressed down, and when the handle is pressed down continuously, the hook releases abruptly from the driver, making the driver rush downward so as to drive staples out of the staple gun, through the help of the elasticity force of the spring means.

12. The hand-held staple gun as claimed in claim 11, wherein the driver is formed with an opening, an engaging hole, and an impact portion at the lower part of the driver, with the second end of the spring means received in the engaging hole of the driver.

13. The hand-held staple gun as claimed in claim 11, wherein the first end of the actuation control rod is sleeved with a cap.

14. The hand-held staple gun as claimed in claim 11, wherein the spring means has its first end received and fixed in a recess of the housing.

15. A hand-held staple gun, comprising:

a housing, including a left side, a right side, a first chute having an outlet, and a second chute having an outlet;

a safe actuation mechanism, including a hook, and an actuation control rod having a vertical end movably disposed in and stretching downward out of the outlet of the second chute of the housing and a horizontal end abutting on a rear end of the hook such that the actuation control rod is biased by the elastic force of a torsion spring coaxially fixed on the housing with the handle;

a driver being movably received in the first chute of the housing and spaced apart from and paralleled with the actuation control rod of the safe actuation mechanism and being driven out of the outlet of the first chute by an elastic force;

a spring means, having a first end fixed in the housing, and having a second end engaging the driver; and a handle, being pivotally secured to the housing, and with the hook pivotally secured to the handle, and with one end of the torsion spring pressed on the housing and another end of the torsion spring pressed on the handle;

whereby, when the staple gun is not in use, the hook cannot engage the driver even if the handle is pressed down, and when the staple gun is in use, the vertical end of the actuation control rod is pressed upward into the second chute of the housing, so that the horizontal end of the actuation control rod pushes the hook, making the hook engage the driver, where the driver, being biased by the spring means, is moved upward when the handle is pressed down, and when the handle is pressed down continuously, the hook releases abruptly from the driver, making the driver rush downward so as to drive staples out of the staple gun, through the help of the elasticity force of the spring means.

16. The hand-held staple gun as claimed in claim 15, wherein the driver is formed with an opening, an engaging hole, and an impact portion at the lower part of the driver, with the second end of the spring means received in the engaging hole of the driver.

17. The hand-held staple gun as claimed in claim 15, wherein the vertical end of the actuation control rod is sleeved with a cap.

18. The hand-held staple gun as claimed in claim 15, wherein the spring means has its first end received and fixed in a recess of the housing.

* * * * *